US005723799A

United States Patent [19]

Murayama et al.

[11] Patent Number: 5,723,799

[45] Date of Patent: Mar. 3, 1998

[54] METHOD FOR PRODUCTION OF METAL-BASED COMPOSITES WITH OXIDE PARTICLE DISPERSION

[75] Inventors: Norimitsu Murayama; Yasuyoshi Torii, both of Aichi, Japan

[73] Assignee: Director General of Agency of Industrial Science and Technology, Tokyo, Japan

[21] Appl. No.: 678,535

[22] Filed: Jul. 5, 1996

[30] Foreign Application Priority Data

Jul. 7, 1995 [JP] Japan ..... 7-195855

[51] Int. Cl.[6] ..... B22F 1/00

[52] U.S. Cl. ..... 75/232; 75/233; 419/19; 419/23; 419/57; 419/58; 419/45

[58] Field of Search ..... 419/19, 23, 57, 419/58, 45; 75/232, 233

[56] References Cited

U.S. PATENT DOCUMENTS

| | | |
|---|---|---|
| 4,619,699 | 10/1986 | Petkovic-Luton et al. . |
| 4,647,304 | 3/1987 | Petkovic-Luton et al. . |
| 5,049,355 | 9/1991 | Gennari et al. . |
| 5,551,970 | 9/1996 | Danelia . |

OTHER PUBLICATIONS

Journal of Japan Institute of Metals, vol. 53, No. 2, pp. 221–226, 1989, Koji Hayashi, et al., "Pressure–Sintering of Iron, Cobalt, Nickel and Copper Ultrafine Powders and the Crystal Grain Size and Hardness of the Compacts".

The International Journal of Powder Metallurgy, vol. 30, No. 1, pp. 59–66, 1994, R.A. Andrievski, "Compaction and Sintering of Ultrafine Powders".

*Primary Examiner*—Ngoclan Mai
*Assistant Examiner*—Anthony R. Chi
*Attorney, Agent, or Firm*—Oblon, Spivak, McClelland, Maier & Neustadt, P.C.

[57] ABSTRACT

The present invention provides metal-based composite with oxide particle dispersion and a method for producing the same.

The present invention relates to a method for producing metal-based composite with oxide particle dispersion, comprising sintering of metal-based ultrafine powders (with an average grain size of about 20 nm to 100 nm and a grain size distribution of about 5 nm to 300 nm and with the surface oxidized for handling) in vacuum, in an inert gas or in a reducing atmosphere by rapid sintering, crystallizing the ultrafine powders with a grain size of about 50 nm or less to metal oxide during sintering and simultaneously removing the oxygen on the surface of the ultrafine powders with the grain size of about 50 nm or more, and the metal-based composite with oxide particle dispersion produced according to the said method.

4 Claims, 1 Drawing Sheet

METHOD FOR PRODUCTION OF METAL-BASED COMPOSITES WITH OXIDE PARTICLE DISPERSION

DESCRIPTION OF THE INVENTION

The present invention relates to a method for producing useful metal-based composites with oxide particle dispersion by sintering metal-based ultrafine powders with specific properties according to rapid sintering, and the composites; more specifically, the present invention relates to a method for producing the metal-based composites with oxide particle dispersion, which enables to produce novel nanostructured composites with metal oxide with grain size of several tens nm levels dispersed at intra/inter metal matrix grains with a grain size of several hundreds nm levels, having specific resistance relatively close to that of metal single crystal, high strength, high hardness, low thermal conductivity and high electrical conductivity, by employing metal-based ultrafine powders with a specific average grain size and a specific grain size distribution and with the surface oxidized for handling, and sintering them rapidly, thereby converting a part of the metal-based ultrafine powders to metal oxide during sintering.

BACKGROUND OF THE INVENTION

Nanostructured bulk materials are characterized by having a very high volume ratio of their inter grain parts and expected as materials exhibiting novel functions such as catalyst materials, sensor materials, hydrogen-storing materials and superplastic materials. Not only a technology of synthesizing ultrafine powders of the order of 10 nm to 100 nm but also a technology of sintering ultrafine powders with depressing the grain growth is indispensable for the development of nanostructured bulk materials.

Resistanse sintering is one of hopeful sintering methods satisfying these conditions. This method is one of uniaxial pressure-sintering similarly to hot pressing; since it comprises applying pulse current directly onto electrically conductive powder compacts through an electrically conductive press bar, and joule-heating the sample uniformly and rapidly, it can depress the grain growth. Recently, several attempts of sintering metal powders by this method have been reported. However, no result of resistanse sintering of metal-based ultrafine powders has been reported yet.

With a view to preparing metal-based composites with oxide particle dispersion, has been employed a method comprising mixing oxide powders and metal powders and sintering the mixure; the method has a problem, however, that since it needs a process of mixing the oxide powders and the metal powders for preparing the mixed powers, it takes much time to prepare it.

Besides, various attempts of preparing fine grain sintered bodies of metals and alloys have been performed by employing metal ultrafine powders, and sintering them by uniaxially pressure-sintering, and various results of analysis regarding the grain size and densification behavior of the obtained sintered bodies have been reported. According to the prior arts of them most similar to the present invention, results of experiments regarding preparation of dense sintered bodies by sintering iron, cobalt, nickel and copper ultrafine powders with an average grain size of 0.02 to 0.05 μm, the conditions for densifying, the grain sizes and hardness of these sintered bodies have been reported (Journal of Japan Institute of Metals, Vol. 53, No. 2, pp. 221–226 (1989)). However, the above bodies are obtained by sintering metal ultrafine powders by uniaxially pressure-sintering in hydrogen gas, from which oxygen is removed in advance according to a heat treatment in hydrogen gas, without employing any mold; the method is different from the way using oxidized metal ultrafine powders according to the present invention, and the obtained composite materials are substantially different from that of the present invention.

As a very recent publication, a report regarding the characteristics of sintered body obtained by pressure-sintering of metal ultrafine powders (UFP) of 100 nm or less has been performed, wherein the characteristics of the sintered bodies of ultrafine powders (UFP) such as that of nickel, copper and silicon nitride are disclosed (The International Journal of Powder Metallurgy, Vol. 30, No. 1, pp. 59–66 (1994)). However, the reference describes that the oxidation of ultrafine powders increases the electrical resistance of sintered bodies remarkably and that UFP can reduce oxidation remarkably by being stored in the state of molded articles, thus showing that oxidation should be deleted in the process of storing and sintering of UFP.

Thus, though various reports regarding the densification of metal ultrafine powders by pressure-sintering have been performed, they are all performed on the assumption that metal ultrafine powders from which oxygen is removed as much as possible are pressure-sintered, and no useful result of employing oxidized metal ultrafine powders as material powders has been reported yet; no report regarding the characteristics of sintered body with oxide particle dispersion obtained by sintering rapidly such material has been found, either.

SUMMARY OF THE INVENTION

The present invention provides metal-based composites with oxide particle dispersion and a method for producing the same.

The present invention relates to a method for producing metal-based composites with oxide particle dispersion with metal oxide dispersed in metal matrix, comprising sintering of metal-based ultrafine powders (with an average grain size of about 20 nm to 100 nm and a grain size distribution of about 5 nm to 300 nm and with the surface oxidized for handling) in vacuum, in an inert gas or in a reducing atmosphere by rapid sintering, crystallizing the ultrafine powders with a grain size of about 50 nm or less to metal oxide during sintering and simultaneously removing the oxygen on the surface of the ultrafine powders with the grain size of about 50 nm or more and the metal-based composites with oxide particle dispersion produced according to the said method.

According to the present invention, novel composites with metal oxide with a grain size of about 50 nm or less dispersed at intra/inter metal matrix grains with an average grain size of about 500 nm or less can be obtained. The composites having resistivity relatively close to that of metal single crystal and thermal conductivity lower than that of single crystal can be obtained. In addition, since the above composites have excellent characteristics such as excellent electrical conductivity, low thermal conductivity, high strength and high hardness, the composites are useful as thermoelectric conversion materials, high-strength and high-hardness metal materials and high-magnetic permeability materials. Moreover, the metal-based composites with oxide particle dispersion can be prepared simply without a process of mixing oxide powder and metal powder, which has been deemed indispensable for preparing a metal-based composite with oxide particle dispersion.

DETAILED DESCRIPTION OF THE INVENTION

Figure 1:
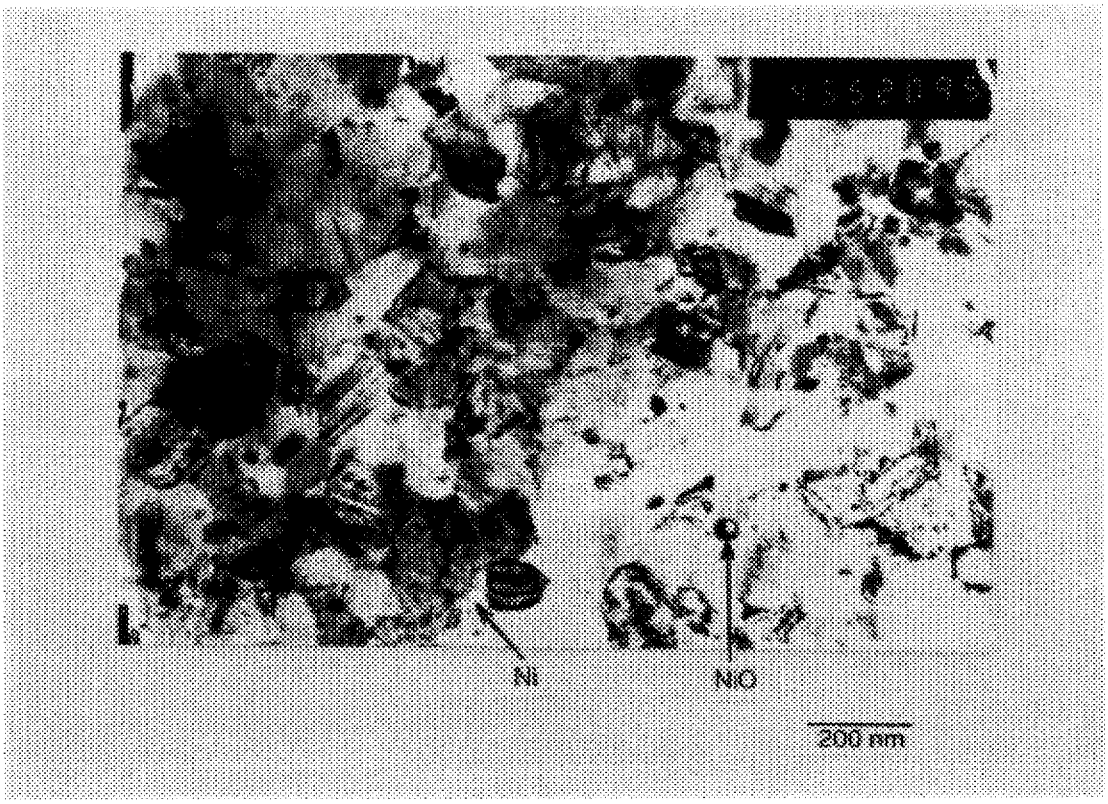
FIG. 1 shows a transmission electron microscope photograph of the crystal structure of the composite with NiO particles of about 40 nm dispersed at intra/inter Ni matrix grains with an average grain size of about 210 nm, obtained according to the method of the present invention.

Under these circumstances, the present inventors have engaged in assiduous studies with a view to developing a novel nanostructured composite with oxide particle dispersion having excellent properties, and as a result have found that the novel composite with metal oxide with a specific grain size dispersed at intra/inter metal matrix grains with a specific average grain size can be obtained according to rapid sintering by resistanse heating, employing a simple process without a process of mixing oxide powder and metal powder conventionally needed, and that said composite has various excellent characteristics and is extremely useful, which has led to the accomplishment of the present invention.

It is an object of the present invention to provide a method for producing novel metal-based composite with oxide particle dispersion by employing metal ultrafine powders with the surface oxidized for handling simply, without a process of mixing oxide powder and metal powder conventionally needed.

It is another object of the present invention to provide novel composites with metal oxide with a grain size of several tens nm levels dispersed at intra/inter metal matrix grains with an average grain size of several hundreds nm.

Moreover, it is still another object of the present invention to provide novel composites having excellent characteristics such as excellent electrical conductivity, low thermal conductivity, high strength and high hardness.

The present invention dissolving the above problems is concerned with a method for producing metal-based composite with oxide particle dispersion with metal oxide dispersed in metal-based matrix, comprising sintering of metal ultrafine powders (with an average grain size of about 20 nm to 100 nm and a grain size distribution of about 5 nm to 300 nm and with the surface oxidized for handling) in vacuum, in an inert gas or in a reducing atmosphere by rapid sintering, crystallizing the ultrafine powders with a grain size of about 50 nm or less to metal oxide during sintering and simultaneously removing the oxygen on the surface of the ultrafine powders with the grain size of about 50 nm or more.

Another embodiment of the present invention is a method for producing the above metal-based composite with oxide particle dispersion, wherein rapid sintering is used as one of resistanse sintering.

Still another embodiment of the present invention is a method for producing the above metal-based composite with oxide particle dispersion, wherein the metal ultrafine powders are one selected from that of nickel, cobalt, copper, iron, magnesium, titanium, molybdenum, tungsten, silver, zinc, aluminum, bismuth telluride compounds and lead telluride compounds.

Moreover, the present invention dissolving the above problems is concerned with metal-based composite with oxide particle dispersion with metal oxide with an average grain size of 50 nm or less dispersed in the metal matrix with an average grain size of 500 nm or less, produced according to the above method.

As described above, the present invention is characterized by rapid sintering of metal ultrafine powders with specific properties, with a specific average grain size and a specific grain size distribution and with the surface oxidized for handling; in particular, it is characterized by employing metal ultrafine powders with an average grain size of about 20 nm to 100 nm, preferably of 50 nm to 80 nm, and a grain size distribution of about 5 nm to 300 nm, preferably of 10 nm to 130 nm, as material powders. In this case, the metal ultrafine powders with a grain size distribution containing ultrafine powders of about 50 nm or less and ultrafine powders of about 50 nm or more are employed preferably from the viewpoint of the characteristics of the composite to be obtained. The kind of the above metal ultrafine powders are not particularly restricted and preferable examples thereof include that of nickel, cobalt, copper, iron, magnesium, titanium, molybdenum, tungsten, silver, zinc, aluminum, bismuth telluride compounds and lead telluride compounds.

These metal ultrafine powders can be used irrespective the method of preparation thereof so far as they have the above average grain size and grain size distribution; for example, commercially available ultrafine powders can be used and method of preparing them are not particularly restricted. These metal ultrafine powders are used after the surface thereof are oxidized; the oxidation treatment may be performed according to short-time heat treatment in oxygen at a temperature of several hundreds ° C. and method of the treatment are not particularly restricted. The amount of oxygen in metal ultrafine powders is preferably from 1.8 to 2.5 weight %.

Metal ultrafine powders with the surface oxidized for handling are sintered according to rapid sintering in vacuum, in an inert gas or in a reducing atmosphere. It becomes possible thereby to depress the grain growth during sintering, to crystallize the ultrafine powders with a grain size of about 50 nm or less to metal oxide, and simultaneously to remove oxygen on the surface of the ultrafine powders with the grain size of about 50 nm or more, and it also becomes possible to prepare metal-based composite with oxide particle dispersion with metal oxide dispersed in metal matrix excellently. In this case, as a preferable method of rapid sintering can be mentioned rapid sintering by resistanse heating and image furnace heating, but, in addition to the above, any method capable of performing rapid sintering in the same manner as the above can be employed similarly.

The conditions of the rapid sintering are preferably the pulse current of 1000 A, uniaxial pressure of 70 MPa and $10^{-2}$ Torr in the case of rapid sintering by resistanse heating; however, it goes without saying that these conditions may be altered suitably in accordance with the kinds and properties of metal ultrafine powders and objective materials. As a sintering equipment is used a spark plasma sintering equipment.

According to the above rapid sintering can be obtained metal-based composite with oxide particle dispersion with metal oxide with an average grain size of about 50 nm or less dispersed at intra/inter metal matrix grains with an average grain size of about 500 nm or less. In the present invention, as shown in Example below, the novel composite with NiO particles of about 40 nm dispersed at intra/inter Ni matrix grains with an average grain size of about 210 nm, sintered to the relative density of about 97% could be obtained according to resistanse heating sintering nickel ultrafine powders with specific properties and with the surface oxidized. The amount of oxygen of the obtained sintered body varies according to the amount of oxygen of the metal ultrafine powders used; it is generally from about 1.0 to 1.5 weight %.

A sintered body to be obtained according to the present invention has relative density of about 98%, resistivity at room temperature relatively close to that of metal single crystal, thermal conductivity lower than that of single crystal, and extremely excellent characteristics such as excellent electrical conductivity, low thermal conductivity, high strength and high hardness; hence the composite according to the present invention is useful as a thermoelectric conversion material, a high-strength and high-hardness metal material and a high-magnetic permeability material.

EXAMPLES

Hereunder, the present invention will be described more specifically according to Examples, but the present invention is restricted to said Examples by no means.

Example 1

1) Preparation of Sintered Body according to Rapid Sintering

Present Example shows the case of performing rapid sintering by resistanse heating employing nickel ultrafine powders.

Nickel ultrafine powders with an average grain size of about 60 nm and a grain size distribution of 10 to 130 nm and with the surface oxidized for handling were sintered rapidly by resistanse heating with a spark plasma sintering equipment (purchased from Sumitomo Sekitan Kogyo) under the conditions of the pulse current of 1000 A, uniaxial pressure of 70 MPa, $10^{-2}$ Torr and one minute to prepare the sintered body densified to the relative density of about 97%. The amounts of oxygen of the nickel ultrafine powders and the sintered body were 2.26 weight % and 1.29 weight %, respectively.

2) Characteristics of the Composite

The results of observing the sintered body obtained according to the above method with transmission electron microscope are shown in FIG. 1. As shown in FIG. 1 clearly, NiO/Ni composite with NiO particles of about 40 nm dispersed at intra/inter Ni matrix grains with an average grain size of about 210 nm was obtained. The obtained sintered body has the resistivity at room temperature of $1.2\times10^{-5}$ ohm·cm relatively close to that of Ni single crystal, and thermal conductivity lower than that of Ni single crystal.

As a result of performing rapid sintering by resistanse heating in the same manner for oxidized metal ultrafine powders of nickel, cobalt, copper, iron, magnesium, titanium, molybdenum, tungsten, silver, zinc, aluminum, bismuth telluride compounds and lead telluride compounds similarly, almost the same results as in Example 1 above could be obtained.

As described in detail above, the present invention relates to a method for producing metal-based composite with metal oxide particle dispersed in metal matrix, comprising sintering of metal ultrafine powders (with an average grain size of about 20 nm to 100 nm and a grain size distribution of about 5 nm to 300 nm and with the surface oxidized for handling) in vacuum, in an inert gas or in a reducing atmosphere by rapid sintering, crystallizing the ultrafine powders with the grain size of about 50 nm or less to a metal oxide during sintering and simultaneously removing the oxygen on the surface of the ultrafine powders with a grain size of about 50 nm or more, and the following effects can be obtained according to the present invention.

(1) A novel composite with metal oxide with a grain size of about 50 nm or less dispersed at intra/inter metal-based matrix grains with an average grain size of about 500 nm or less can be obtained.

(2) A composite having resistivity relatively close to that of metal single crystal and thermal conductivity lower than that of single crystal can be obtained.

(3) Since the above composite material has excellent characteristics such as excellent electrical conductivity, low thermal conductivity, high strength and high hardness, it is useful as a thermoelectric conversion material, a high-strength and high-hardness metal material and a high-magnetic permeability material.

(4) A metal-based composite with oxide particle dispersion can be prepared simply, without the process of mixing oxide powder and metal powder at all, which has been deemed indispensable for preparing a metal-based composite with oxide particle dispersion in previous methods.

We claim:

1. A method for producing metal-based composite with oxide particle dispersion, comprising sintering of metal-based ultrafine powders (with an average grain size of about 20 nm to 100 nm and the grain size distribution of about 5 nm to 300 nm and with the surface oxidized for handling) in vacuum, in an inert gas or in a reducing atmosphere by rapid sintering, crystallizing the ultrafine powders with a grain size of about 50 nm or less to metal oxide during sintering and simultaneously removing the oxygen on the surface of the ultrafine powder with the grain size of about 50 nm or more.

2. The method for producing the metal-based composite with oxide particle dispersion according to claim 1, wherein resistanse sintering is used as one of rapid sintering.

3. The method for producing the metal-based composite with oxide particle dispersion according to claim 1, wherein the metal-based ultrafine powders are one selected from that of nickel, cobalt, copper, iron, magnesium, titanium, molybdenum, tungsten, silver, zinc, aluminum, bismuth telluride compounds and lead telluride compounds.

4. The metal-based composite with oxide particle dispersion in which metal oxide with an average grain size of 50 nm or less is dispersed in metal-based matrix with an average grain size of 500 nm or less, produced according to the method for production described in claim 1.

* * * * *